US010584718B2

(12) United States Patent
Hayamitsu

(10) Patent No.: US 10,584,718 B2
(45) Date of Patent: Mar. 10, 2020

(54) IMPELLER AND BLOWER

(71) Applicant: Nidec Corporation, Minami-ku, Kyoto (JP)

(72) Inventor: Ryosuke Hayamitsu, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 208 days.

(21) Appl. No.: 15/917,889

(22) Filed: Mar. 12, 2018

(65) Prior Publication Data

US 2018/0202459 A1 Jul. 19, 2018

Related U.S. Application Data

(63) Continuation of application No. 14/820,638, filed on Aug. 7, 2015, now Pat. No. 9,951,788.

(30) Foreign Application Priority Data

Aug. 29, 2014 (JP) ..... 2014-175598

(51) Int. Cl.
*F04D 29/42* (2006.01)
*F04D 25/08* (2006.01)
(Continued)

(52) U.S. Cl.
CPC ..... *F04D 29/4253* (2013.01); *F04D 25/08* (2013.01); *F04D 29/282* (2013.01); *F04D 29/384* (2013.01)

(58) Field of Classification Search
CPC ..... F04D 29/282; F04D 29/30; F04D 29/384; F04D 29/4253; F04D 25/08; F05D 2240/305; F05D 2240/306; F05D 2240/71
See application file for complete search history.

(56) References Cited

U.S. PATENT DOCUMENTS 3,788,765 A * 1/1974 Rusak ..... F04D 29/284 415/227
6,588,485 B1 * 7/2003 Decker ..... B22C 7/02 164/113

(Continued)

FOREIGN PATENT DOCUMENTS

JP 54-14012 A 2/1979
JP 10-306796 A 11/1998
JP 2000-240590 A 9/2000

OTHER PUBLICATIONS

Hayamitsu, "Impeller and Blower", U.S. Appl. No. 14/820,638, filed Aug. 7, 2015.

*Primary Examiner* — Dwayne J White
*Assistant Examiner* — Aye S Htay
(74) *Attorney, Agent, or Firm* — Keating & Bennett

(57) ABSTRACT

An impeller includes a disk-shaped portion and rotor blades. The rotor blades include first rotor blades which includes a first curvature portion and second curvature portions. A center of a radius of curvature of the first curvature portion is on a first side. A center of a radius of curvature of each second curvature portion is on a second side. The radius of curvature of the second curvature portion radially outward is greater than the radius of curvature of the second curvature portion radially inward. The rotor blades include second rotor blades each of which is circumferentially between adjacent ones of the first rotor blades. Each second rotor blade includes third curvature portions. A center of a radius of curvature is on the second side. The radius of curvature of the third curvature portion radially outward is greater than the radius of curvature of the third curvature portion radially inward.

18 Claims, 6 Drawing Sheets

(51) Int. Cl.
*F04D 29/28* (2006.01)
*F04D 29/38* (2006.01)

(56) References Cited

U.S. PATENT DOCUMENTS

2010/0098544 A1* 4/2010 Keber ..... F04D 29/023
416/183
2014/0093366 A1* 4/2014 Otsuka ..... F04D 29/281
415/206
2015/0007815 A1* 1/2015 Duquette ..... F04D 25/08
128/202.27
2016/0010656 A1* 1/2016 Shiraichi ..... F04D 29/282
415/204

* cited by examiner

| | Maximum Air Blowing Efficiency (%) | Maximum Shaft Power (W) |
|---|---|---|
| Preferred Embodiment | 63.1 | 534 |
| Comparative Example | 59.1 | 653 |

Fig. 6

IMPELLER AND BLOWER

BACKGROUND OF THE INVENTION

1. Field of the Invention

The present invention relates to an impeller and a blower.

2. Description of the Related Art

JP-A 03-018694, for example, has proposed an impeller in which a center of the radius of curvature of an air inlet-side portion of each blade is arranged on a forward side of the blade, and in which a center of the radius of curvature of a discharge-side portion of each blade is arranged on a rearward side of the blade.

It is difficult to increase an exit angle of each blade of the impeller as described above, and it may be difficult to achieve a sufficient improvement in air blowing efficiency of the impeller as described above.

SUMMARY OF THE INVENTION

An impeller according to a preferred embodiment of the present invention is arranged to rotate about a central axis, and includes a disk-shaped portion that extends radially with respect to the central axis; and a plurality of rotor blades arranged along a circumferential direction on one surface of the disk-shaped portion, each rotor blade including one end at an outer edge portion of the disk-shaped portion, and an opposite end radially inward of the outer edge portion of the disk-shaped portion. The rotor blades include a plurality of first rotor blades each of which includes a first curvature portion and a plurality of second curvature portions. A center of a radius of curvature of the first curvature portion of each first rotor blade is on a first side of the first rotor blade with respect to the circumferential direction. A center of a radius of curvature of each second curvature portion of each first rotor blade is on a second side of the first rotor blade with respect to the circumferential direction. The first curvature portion is radially inward of each second curvature portion. Regarding adjacent ones of the second curvature portions of each first rotor blade, the radius of curvature of the second curvature portion radially outward is greater than the radius of curvature of the second curvature portion radially inward. The rotor blades further include a plurality of second rotor blades. A radially inner end portion of each second rotor blade is radially outward of a radially inner end portion of each first rotor blade. Each second rotor blade is circumferentially between adjacent ones of the first rotor blades. Each second rotor blade includes a plurality of third curvature portions, a center of a radius of curvature of each third curvature portion being on the second side of the second rotor blade with respect to the circumferential direction. Regarding adjacent ones of the third curvature portions, the radius of curvature of the third curvature portion radially outward is greater than the radius of curvature of the third curvature portion radially inward.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 6 is a table showing results of a simulation, comparing a preferred embodiment of the present invention with a comparative example.

DETAILED DESCRIPTION OF THE PREFERRED EMBODIMENTS

Hereinafter, an impeller and a blower according to a preferred embodiment of the present invention will be described with reference to the accompanying drawings. Note that the scope of the present invention is not limited to the preferred embodiment described below, but includes any modification thereof within the scope of the technical idea of the present invention. Also note that scales, numbers, and so on of members or portions illustrated in the following drawings may differ from those of actual members or portions, for the sake of easier understanding of the members or portions.

In the following drawings, an xyz coordinate system is shown appropriately as a three-dimensional orthogonal coordinate system. A z-axis direction is assumed to be a direction parallel to a direction in which a central axis J extends in FIG. 1. A y-axis direction is assumed to be a direction perpendicular to the z-axis direction. An x-axis direction is assumed to be a direction perpendicular to both the y-axis direction and the z-axis direction.

In the following description, a +z side in the z-axis direction is assumed to be an inlet side, while a −z side in the z-axis direction is assumed to be an outlet side. In addition, a circumferential direction about a z-axis is assumed to be a θz direction. Further, unless otherwise specified, the terms "radial direction", "radial", and "radially" as used herein refer to radial directions with respect to a rotating shaft 31 illustrated in FIG. 1, the terms "circumferential direction", "circumferential", and "circumferentially" as used herein refer to a circumferential direction about the rotating shaft 31, and the terms "axial direction", "axial", and "axially" as used herein refer to an axial direction with respect to the rotating shaft 31.

Figure 1:
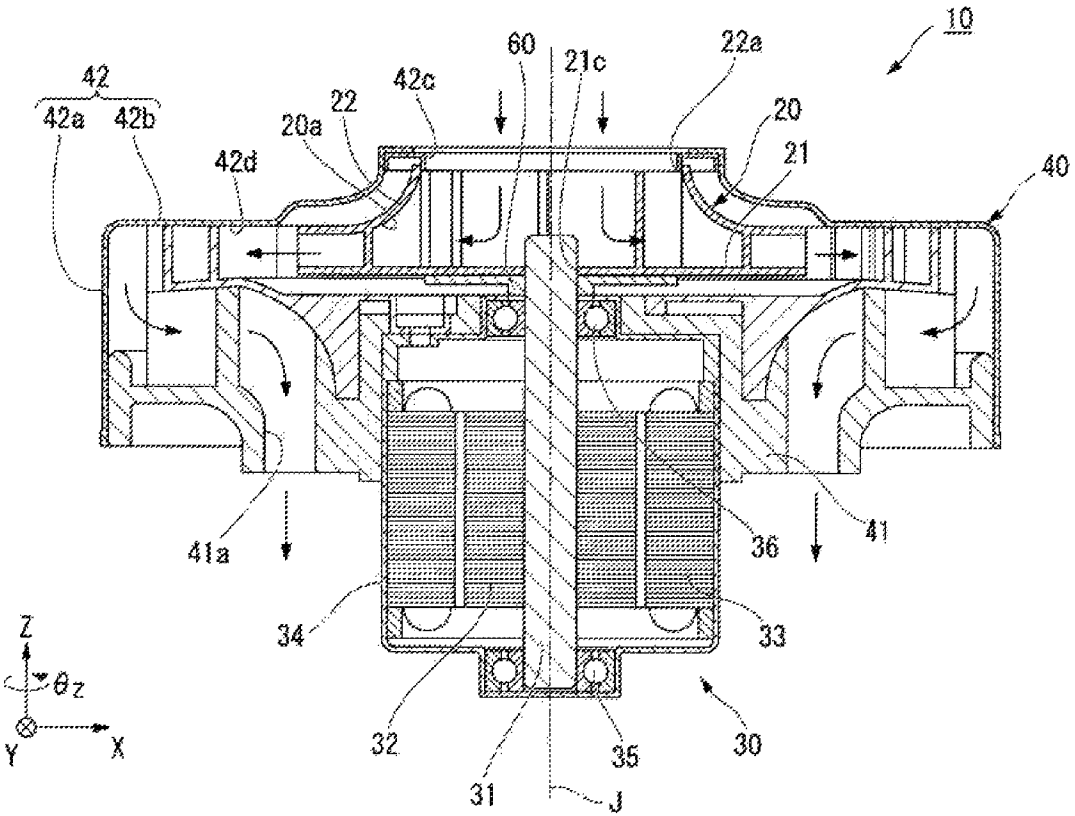
FIG. 1 is a cross-sectional view of a blower according to a preferred embodiment of the present invention.

FIG. 1 is a cross-sectional view (i.e., a z-x cross-sectional view) of a blower 10 according to a preferred embodiment of the present invention.

Referring to FIG. 1, the blower 10 includes an impeller 20, a motor 30, and an impeller housing 40. More specifically, the blower 10 includes the impeller 20, the motor 30, which is arranged to rotate the impeller 20 about the central axis J, and the impeller housing 40, which is arranged to accommodate the impeller 20. This structure enhances air blowing efficiency of the blower 10 including the impeller 20 described below.

The impeller housing 40 is attached on the inlet side (i.e., the +z side) of the motor 30. The impeller 20 is accommodated inside the impeller housing 40. The impeller 20 is attached to the motor 30 such that the impeller 20 is rotatable about the central axis J. The impeller 20 is thus arranged to rotate about the central axis J. The impeller 20 according to the present preferred embodiment is, for example, an impeller including a tubular shroud 22. Various portions of the blower 10 will be described in detail below.

Motor

The motor 30 is arranged to rotate the impeller 20 about the central axis J (i.e., in the $\theta_z$ direction).

The motor 30 includes the rotating shaft 31, a rotor 32, a stator 33, a motor housing 34, an outlet side bearing 35, and an inlet side bearing 36.

The rotating shaft 31 is arranged to extend in an axial direction of the central axis J, with the central axis J as a center thereof. The rotating shaft 31 is supported by the outlet side bearing 35 and the inlet side bearing 36 such that the rotating shaft 31 is rotatable about the central axis J (i.e., in the $\theta_z$ direction). A flange member 60 is attached to the rotating shaft 31 on the inlet side (i.e., the +z side) of the inlet side bearing 36. An inlet-side end surface of the flange member 60 is fixed to a disk-shaped portion 21 of the impeller 20, which will be described below. The impeller 20 is thus attached to the rotating shaft 31. As a result, the impeller 20 is arranged to rotate about the central axis J together with the rotating shaft 31.

The rotor 32 is arranged to surround the rotating shaft 31, extending around the central axis J (i.e., in the $\theta_z$ direction) radially outside of the rotating shaft 31, and is fixed to the rotating shaft 31. In more detail, the rotor 32 includes a through hole (not shown) arranged to pass through the rotor 32 in the axial direction (i.e., in the z-axis direction). The rotating shaft 31 is arranged to pass through the through hole of the rotor 32. An inside surface of the through hole of the rotor 32 is arranged to hold an outside surface of the rotating shaft 31 through, for example, press fitting or the like. The rotating shaft 31 is thus fixed to the rotor 32.

The stator 33 is arranged radially outside of the rotor 32 with a gap intervening therebetween. The stator 33 is arranged to surround the rotor 32, extending around the central axis J (i.e., in the $\theta_z$ direction).

The motor housing 34 is arranged to accommodate the rotor 32, the stator 33, the outlet side bearing 35, and the inlet side bearing 36. An outside surface of the stator 33 is fitted to an inside surface of the motor housing 34.

The outlet side bearing 35 is arranged on the outlet side (i.e., the −z side) of the rotor 32, and is held by the motor housing 34.

The inlet side bearing 36 is arranged on the inlet side (i.e., the +z side) of the rotor 32, and is held by the motor housing 34.

Impeller Housing

The impeller housing 40 is arranged to accommodate the impeller 20. The impeller housing 40 includes a housing body 41 and a housing cover 42.

The housing body 41 is tubular. An inside surface of the housing body 41 is fitted to an outside surface of the motor housing 34. The housing body 41 is thus attached to the motor 30 on the inlet side (i.e., the +z side) of the motor 30. The housing body 41 includes an outgoing air channel 41*a* arranged radially outside of the motor 30 to surround the motor 30, extending all the way around the motor 30.

The housing cover 42 is arranged on the inlet side (i.e., the +z side) of the housing body 41. The impeller 20 is arranged between the housing cover 42 and the housing body 41. The housing cover 42 includes a tubular portion 42*a* and a bottom portion 42*b* arranged on the inlet side of the tubular portion 42*a*.

An inside surface of the tubular portion 42*a* is fitted to an outside surface of the housing body 41. The housing cover 42 is thus attached to the housing body 41.

An air inlet 42*c*, which is concentric with the rotating shaft 31 and is open to the inlet side (i.e., the +z side), is defined in the bottom portion 42*b*. That is, the impeller housing 40 includes the air inlet 42*c*.

The air inlet 42*c* is arranged at a position opposite to an inlet-side surface 21*a* of the disk-shaped portion 21 of the impeller 20, which will be described below. An outer edge of the air inlet 42*c* is arranged to substantially overlap with an inner edge 22*a* of the shroud 22 of the impeller 20 in a plan view (i.e., an x-y plan view).

A connection air channel 42*d* is arranged between the housing cover 42 and the housing body 41. The connection air channel 42*d* is arranged radially outside of the impeller 20, extending all the way around the impeller 20. The connection air channel 42*d* is arranged to join an incoming air channel 20*a* defined in the impeller 20, which will be described below, and the outgoing air channel 41*a* to each other.

Impeller

Figure 2:
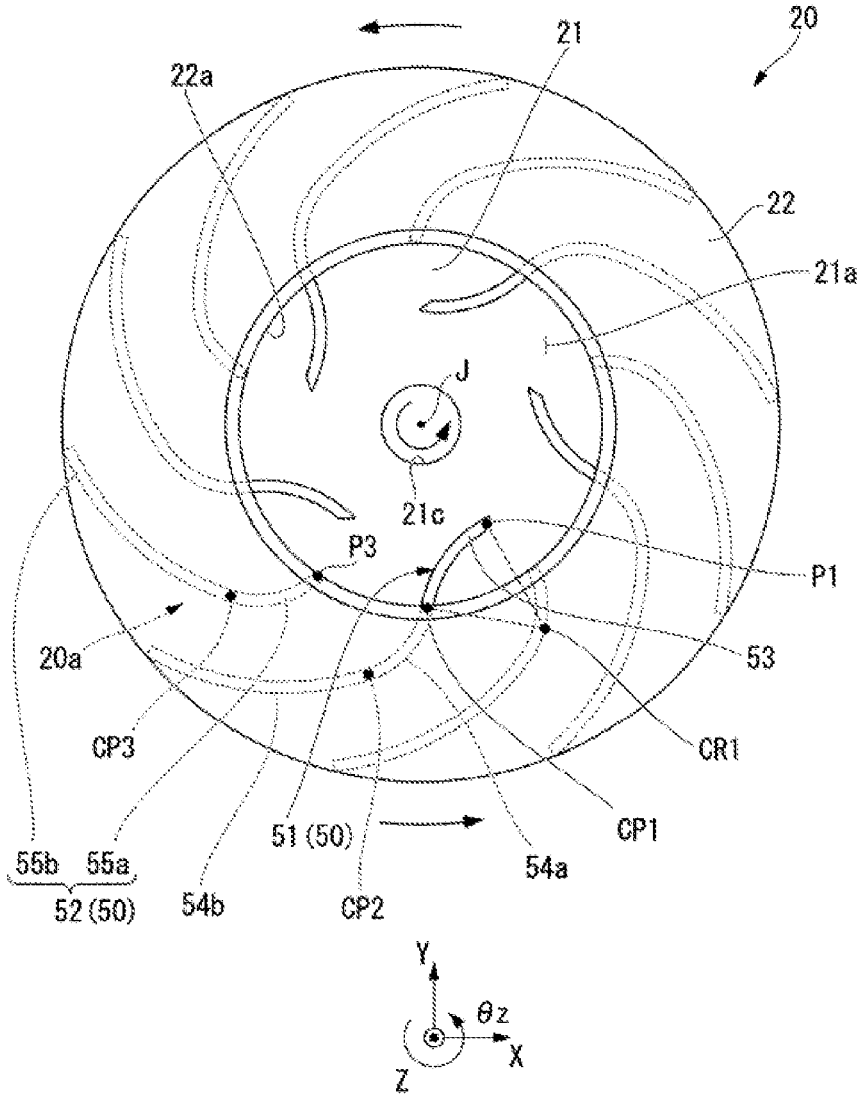
FIG. 2 is a plan view of an impeller according to a preferred embodiment of the present invention.
Figure 3:
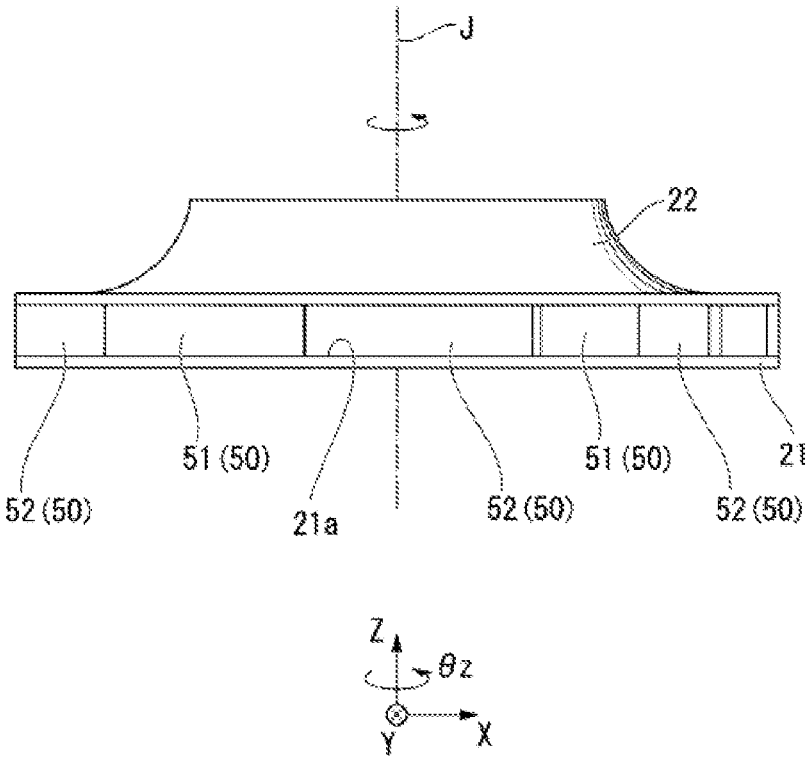
FIG. 3 is a front view of the impeller according to a preferred embodiment of the present invention.
Figure 4:
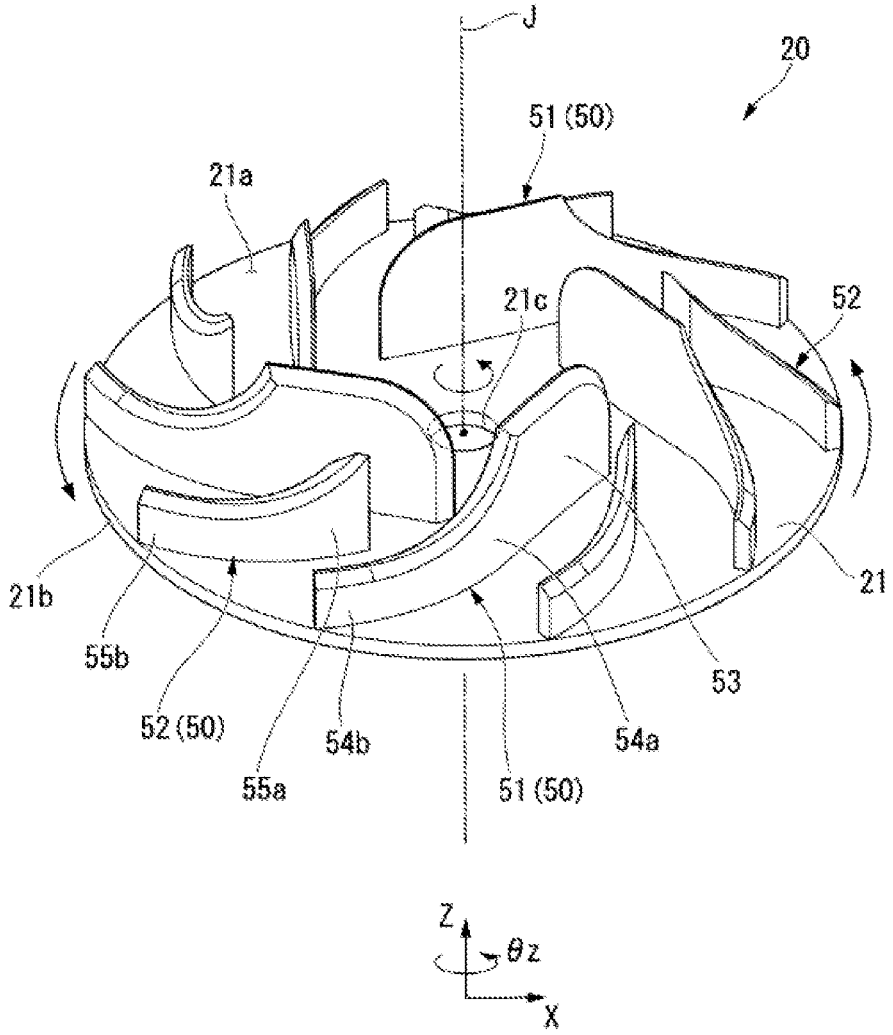
FIG. 4 is a perspective view of the impeller according to a preferred embodiment of the present invention.
Figure 5:
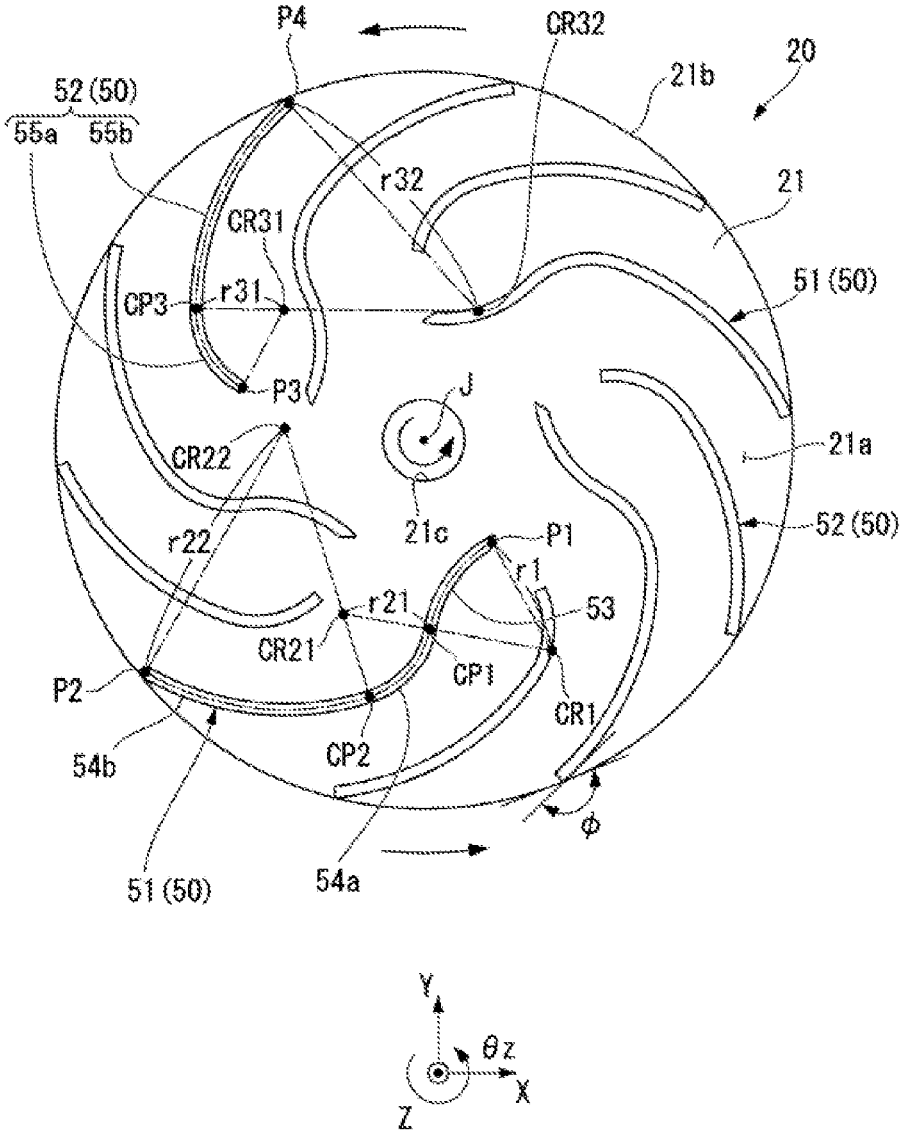
FIG. 5 is a plan view of the impeller according to a preferred embodiment of the present invention.

FIGS. 2, 3, 4, and 5 are each a diagram illustrating the impeller 20. Each of FIGS. 2 and 5 is a plan view. FIG. 3 is a front view (i.e., a z-x plane view). FIG. 4 is a perspective view. The shroud 22 is not shown in each of FIGS. 4 and 5.

Referring to FIGS. 2 to 5, the impeller 20 includes the disk-shaped portion 21, the shroud 22, and a plurality of rotor blades 50. According to the present preferred embodiment, the impeller 20 is arranged to rotate in a counterclockwise direction (i.e., in a +θz direction) about the central axis J when viewed from the inlet side (i.e., the +z side) as indicated in FIGS. 4 and 5.

Note that, in the following description, a side in the circumferential direction toward which the rotor blades 50 of the impeller 20 go will be referred to as a forward side (or a first side or a $+\theta_z$ side), while a side opposite to the forward side in the circumferential direction will be referred to as a rearward side (or a second side or $-\theta_z$ side).

Disk-Shaped Portion

The disk-shaped portion 21 is arranged to extend radially with respect to the central axis J. The disk-shaped portion 21 includes, in a center thereof, a through hole 21*c* arranged to pass therethrough in a thickness direction (i.e., the z-axis direction). The through hole 21*c* is concentric with the disk-shaped portion 21. Referring to FIG. 1, the rotating shaft 31 is inserted through the through hole 21*c*. An end portion of the rotating shaft 31 on the inlet side (i.e., on the +z side) is arranged to project toward the inlet side (i.e., the +z side) relative to the inlet-side surface (i.e., one surface) 21*a* of the disk-shaped portion 21 through the through hole 21*c*.

Shroud

Referring to FIG. 3, the shroud 22 is an annular portion arranged opposite to the inlet-side surface 21*a* of the disk-shaped portion 21. Referring to FIG. 2, the inner edge 22*a* of the shroud 22 is, for example, circular and concentric with the disk-shaped portion 21. An entire portion of the shroud 22 which is radially outward of the inner edge 22*a* is arranged to overlap with the disk-shaped portion 21 in a plan view. The shroud 22 is fixed to the disk-shaped portion 21 through the rotor blades 50. Referring to FIG. 3, the shroud 22 according to the present preferred embodiment is arranged to become more distant in the axial direction (i.e., the z-axis direction) from the disk-shaped portion 21 with decreasing distance from the central axis J.

The incoming air channel 20*a* is defined axially (i.e., in the z-axis direction) between the shroud 22 and the disk-shaped portion 21, and the incoming air channel 20*a* is arranged all the way around the inner edge 22*a*. The incoming air channel 20*a* is divided by the plurality of rotor blades 50. The incoming air channel 20*a* is arranged to be in communication with the air inlet 42*c* of the impeller housing 40, and is open radially outwardly in the impeller 20.

Rotor Blades

The plurality of rotor blades 50 are arranged along the circumferential direction on the one surface of the disk-shaped portion 21. Specifically, referring to FIG. 5, the plurality of rotor blades 50 are arranged along the circumferential direction (i.e., the $\theta_z$ direction) on the inlet-side surface 21*a* of the disk-shaped portion 21. According to the present preferred embodiment, the plurality of rotor blades 50 are arranged at regular intervals along the circumferential direction. According to the present preferred embodiment, the plurality of rotor blades 50 include a plurality of first rotor blades 51 and a plurality of second rotor blades 52. Referring to FIG. 4, each rotor blade 50 is arranged to stand perpendicularly to the inlet-side surface 21*a* on the inlet-side surface 21*a* of the disk-shaped portion 21.

The axial dimension (i.e., the dimension as measured in the z-axis direction) of each rotor blade 50 is arranged to decrease from the inner edge 22*a* of the shroud 22 with increasing distance from the central axis J such that the shape of the rotor blade 50 matches the shape of the shroud 22.

Referring to FIG. 5, each rotor blade 50 is arranged to extend in a curve on the inlet-side surface 21*a* of the disk-shaped portion 21 in a plan view (i.e., an x-y plan view). One end of each rotor blade 50 is arranged at an outer edge portion 21*b* of the disk-shaped portion 21. An opposite end of each rotor blade 50 is arranged radially inward of the outer edge portion 21*b* of the disk-shaped portion 21.

More specifically, an end portion P2 of each first rotor blade 51 is arranged at the outer edge portion 21*b* of the disk-shaped portion 21. An end portion P1 of each first rotor blade 51 is arranged radially inward of the outer edge portion 21*b* of the disk-shaped portion 21. An end portion P4 of each second rotor blade 52 is arranged at the outer edge portion 21*b* of the disk-shaped portion 21. An end portion P3 of each second rotor blade 52 is arranged radially inward of the outer edge portion 21*b* of the disk-shaped portion 21.

According to the present preferred embodiment, the plurality of rotor blades 50 are made up of only the plurality of first rotor blades 51 and the plurality of second rotor blades 52. In the preferred embodiment illustrated in FIG. 5, the number of first rotor blades 51 is five. In addition, in the preferred embodiment illustrated in FIG. 5, the number of second rotor blades 52 is five.

Each first rotor blade 51 includes a first curvature portion 53 and a plurality of second curvature portions. According to the present preferred embodiment, each first rotor blade 51 includes two second curvature portions: a second curvature portion 54*a* and a second curvature portion 54*b*. The first curvature portion 53, the second curvature portion 54*a*, and the second curvature portion 54*b* are arranged in the order named along a length of the first rotor blade 51. According to the present preferred embodiment, each first rotor blade 51 is made up of the first curvature portion 53 and the two second curvature portions 54*a* and 54*b*.

The first curvature portion 53 is arranged radially inward of both the second curvature portion 54*a* and the second curvature portion 54*b*. According to the present preferred embodiment, the first curvature portion 53 is arranged the most radially inward in the first rotor blade 51. That is, the radially inner end portion P1 of the first rotor blade 51 is a radially inner end portion of the first curvature portion 53.

A radially outer end portion of the first curvature portion 53 is joined to a radially inner end portion of the second curvature portion 54*a*. That is, the first curvature portion 53 and the second curvature portion 54*a*, which is adjacent to the first curvature portion 53, are arranged to be continuous with each other. According to the present preferred embodiment, a junction of the first curvature portion 53 and the adjacent second curvature portion 54*a* is arranged at the same radial position as that of an outer edge of the air inlet 42*c*. That is, referring to FIG. 2, a first junction CP1, which is the junction of the first curvature portion 53 and the second curvature portion 54*a*, is arranged at the same radial position as that of the inner edge 22*a* of the shroud 22. As a result, the first curvature portion 53 is arranged radially inward of the inner edge 22*a* of the shroud 22. This arrangement contributes to enhancing air intake efficiency and air exhaust efficiency of the blower 10. According to the present preferred embodiment, the inner edge 22*a* of the shroud 22 and the outer edge of the air inlet 42*c* of the impeller housing 40 are arranged to substantially overlap with each other in a plan view, and therefore, the first junction CP1 is arranged at the same radial position as that of the outer edge of the air inlet 42*c*. In addition, the first curvature portion 53 is arranged radially inward of the outer edge of the air inlet 42*c*. That is, the impeller housing 40 includes the air inlet 42*c*, which is arranged at a position opposite to the one surface 21*a*, and at least a portion of the first curvature portion 53 is arranged radially inward of the outer edge of the air inlet 42*c*. This arrangement contributes to enhancing efficiency of the blower 10.

A center CR1 of the radius of curvature of the first curvature portion 53 of each first rotor blade 51 is arranged on the first side of the first rotor blade 51 with respect to the circumferential direction. In other words, the center CR1 of the radius of curvature of the first curvature portion 53 of each first rotor blade 51 is arranged on the forward side (i.e., the $+\theta_z$ side) of the first rotor blade 51 with respect to the circumferential direction. According to the present preferred embodiment, the center CR1 of the radius of curvature is arranged radially outward of the inner edge 22*a* of the shroud 22. According to the present preferred embodiment, the inner edge 22*a* of the shroud 22 and the outer edge of the air inlet 42*c* of the impeller housing 40 are arranged to substantially overlap with each other in the plan view, and therefore, the center CR1 of the radius of curvature of the first curvature portion 53 is arranged radially outward of the air inlet 42*c*. This arrangement contributes to enhancing the air intake efficiency of the blower 10.

Referring to FIG. 5, the second curvature portion 54*a* is arranged radially outward of the first curvature portion 53, and is arranged to be continuous with the first curvature portion 53. The second curvature portion 54*b* is arranged radially outward of the second curvature portion 54*a*, and is arranged to be continuous with the second curvature portion 54*a*. According to the present preferred embodiment, the second curvature portion 54*b* is arranged the most radially outward in the first rotor blade 51. That is, the radially outer end portion P2 of the first rotor blade 51 is a radially outer end portion of the second curvature portion 54*b*.

A center CR21 of the radius of curvature of the second curvature portion 54*a* of each first rotor blade 51 is arranged on the second side of the first rotor blade 51 with respect to the circumferential direction. In other words, the center CR21 of the radius of curvature of the second curvature portion 54*a* of each first rotor blade 51 is arranged on the rearward side (i.e., the $-\theta_z$ side) of the first rotor blade 51 with respect to the circumferential direction. Similarly, a center CR22 of the radius of curvature of the second curvature portion 54*b* of each first rotor blade 51 is arranged on the rearward side of the first rotor blade 51 with respect to the circumferential direction. In addition, the first curvature portion 53 is arranged radially inward of the second curvature portion 54*a*.

A curvature of the second curvature portion 54*a* and a curvature of the second curvature portion 54*b* are different from each other. That is, a second junction CP2, which is a junction of the second curvature portion 54*a* and the second curvature portion 54*b*, is a curvature change point at which the curvature of the first rotor blade 51 changes.

A radius r21 of curvature of the second curvature portion 54*a* is smaller than a radius r22 of curvature of the second curvature portion 54*b*. In other words, regarding the second curvature portions 54*a* and 54*b*, which are adjacent to each other, the radius r22 of curvature of the second curvature portion 54*b*, which is arranged radially outward, is greater than the radius r21 of curvature of the second curvature portion 54*a*, which is arranged radially inward. This arrangement contributes to enhancing air blowing efficiency of the impeller 20.

According to the present preferred embodiment, the radius r21 of curvature of the second curvature portion 54*a* is smaller than a radius r1 of curvature of the first curvature portion 53. According to the present preferred embodiment, the radius r22 of curvature of the second curvature portion 54*b* is greater than the radius r1 of curvature of the first curvature portion 53. That is, according to the present preferred embodiment, a curvature of the first curvature portion 53, the curvature of the second curvature portion 54*a*, and the curvature of the second curvature portion 54*b* are different from one another, and each of the first junction CP1 and the second junction CP2 is a curvature change point at which the curvature of the first rotor blade 51 changes.

Referring to FIG. 2, according to the present preferred embodiment, the first junction CP1 is arranged at the same radial position as that of the inner edge 22*a* of the shroud 22, and therefore, the second curvature portions 54*a* and 54*b*, each of which is arranged radially outward of the first curvature portion 53, are both arranged radially outward of the inner edge 22*a* of the shroud 22. According to the present preferred embodiment, the inner edge 22*a* of the shroud 22 and the outer edge of the air inlet 42*c* of the impeller housing 40 are arranged to substantially overlap with each other in the plan view. That is, each of the second curvature portions 54*a* and 54*b* is arranged radially outward of the air inlet 42*c*. This arrangement contributes to enhancing the air exhaust efficiency of the blower 10.

According to the present preferred embodiment, a length of the second curvature portion 54*b* is greater than a length of the first curvature portion 53, and the length of the first curvature portion 53 is greater than a length of the second curvature portion 54*a*, for example. That is, the length of the second curvature portion 54*b*, which is arranged radially outward, is greater than the length of the second curvature portion 54*a*, which is arranged radially inward.

Referring to FIG. 5, each second rotor blade 52 is arranged circumferentially between adjacent ones of the first rotor blades 51. The radially inner end portion P3 of each second rotor blade 52 is arranged radially outward of the radially inner end portion P1 of each first rotor blade 51. Referring to FIG. 2, according to the present preferred embodiment, the end portion P3 of each second rotor blade 52 is arranged at the same radial position as that of the inner edge 22*a* of the shroud 22. As a result, each second rotor blade 52 is arranged radially outward of the inner edge 22*a* of the shroud 22.

Referring to FIG. 5, each second rotor blade 52 includes a plurality of third curvature portions. According to the present preferred embodiment, a third curvature portion 55*a* and a third curvature portion 55*b* are provided as the third curvature portions. According to the present preferred embodiment, each second rotor blade 52 is made up of the two third curvature portions 55*a* and 55*b*.

The third curvature portion 55*a* is a radially inner portion of the second rotor blade 52. The third curvature portion 55*b* is a radially outer portion of the second rotor blade 52. That is, the radially inner end portion P3 of the second rotor blade 52 is a radially inner end portion of the third curvature portion 55*a*. The radially outer end portion P4 of the second rotor blade 52 is a radially outer end portion of the third curvature portion 55*b*.

A center CR31 of the radius of curvature of the third curvature portion 55*a* of each second rotor blade 52 is arranged on the rearward side (i.e., the $-\theta_z$ side) of the second rotor blade 52 with respect to the circumferential direction. Similarly, a center CR32 of the radius of curvature of the third curvature portion 55*b* of each second rotor blade 52 is arranged on the rearward side of the second rotor blade 52 with respect to the circumferential direction.

A curvature of the third curvature portion 55*a* and a curvature of the third curvature portion 55*b* are different from each other. That is, a third junction CP3, which is a junction of the third curvature portion 55*a* and the third curvature portion 55*b*, is a curvature change point at which the curvature of the second rotor blade 52 changes.

A radius r31 of curvature of the third curvature portion 55*a* is smaller than a radius r32 of curvature of the third curvature portion 55*b*. In other words, regarding the third curvature portions 55*a* and 55*b*, which are adjacent to each other, the radius r32 of curvature of the third curvature portion 55*b*, which is arranged radially outward, is greater than the radius r31 of curvature of the third curvature portion 55*a*, which is arranged radially inward.

According to the present preferred embodiment, the radius r31 of curvature of the third curvature portion 55*a*, which is arranged radially inward, is equal to the radius r21 of curvature of the second curvature portion 54*a*, which is arranged radially inward. In addition, according to the present preferred embodiment, the radius r32 of curvature of the third curvature portion 55*b*, which is arranged radially outward, is equal to the radius r22 of curvature of the second curvature portion 54*b*, which is arranged radially outward.

Moreover, a length of the third curvature portion 55*a* is equal to the length of the second curvature portion 54*a*. A length of the third curvature portion 55*b* is equal to the length of the second curvature portion 54*b*.

That is, according to the present preferred embodiment, the shape of the second rotor blade 52 is identical to the shape of an entire portion of the first rotor blade 51, excluding the first curvature portion 53.

Once the motor 30 causes the impeller 20 to start rotating, air flows into the impeller 20 through the air inlet 42*c*. The air then passes through the incoming air channel 20*a*, which is divided by the rotor blades 50, and is discharged radially outward from the impeller 20.

Here, the air is sucked into the incoming air channel 20*a* through the first curvature portion 53 of each first rotor blade 51 in the impeller 20. Then, the air is discharged out of the incoming air channel 20*a* through the second curvature portions 54*a* and 54*b* of each first rotor blade 51 and each second rotor blade 52.

After being discharged out of the impeller 20, the air passes through the connection air channel 42*d* and the outgoing air channel 41*a*, and is discharged on the outlet side (i.e., the −z side) of the impeller housing 40. The blower 10 according to the present preferred embodiment is able to send the air to the outlet side in the above-described manner.

According to the present preferred embodiment, each first rotor blade 51 includes the first curvature portion 53, the center CR1 of the radius of curvature of which is arranged on the forward side of the first rotor blade 51, and the two second curvature portions 54*a* and 54*b*, the centers CR21 and CR22 of the radii of curvature of which are arranged on the rearward side of the first rotor blade 51. In addition, regarding the two second curvature portions 54*a* and 54*b*, the radius r22 of curvature of the second curvature portion 54*b*, which is arranged radially outward, is greater than the radius r21 of curvature of the second curvature portion 54*a*, which is arranged radially inward. This allows the radius r21 of curvature of the second curvature portion 54*a*, which is arranged radially inward, to be small while increasing an exit angle Φ defined by a tangent to the first rotor blade 51 at the radially outer end portion P2 of the first rotor blade 51 with a tangent to the outer edge portion 21*b* of the disk-shaped portion at the radially outer end portion P2. This contributes to reducing the likelihood that the air taken into the incoming air channel 20*a* through the first curvature portion 53 will separate from the rotor blade 50 while facilitating discharge of the air out of the incoming air channel 20*a*. Thus, according to the present preferred embodiment, an impeller having a structure which enables air to be efficiently discharged to improve air blowing efficiency of the impeller, and a blower including such an impeller, are provided.

In addition, according to the present preferred embodiment, each first rotor blade 51 is made up of the first curvature portion 53 and the two second curvature portions 54*a* and 54*b*. That is, the plurality of second curvature portions included in each first rotor blade 51 are only two in number. Therefore, according to the present preferred embodiment, it is easy to manufacture the first rotor blade 51. This is particularly effective when reducing the size of the impeller 20. This is because, when the size of the impeller 20 is reduced, the size of the first rotor blade 51 is also reduced, making manufacture thereof generally difficult.

In addition, according to the present preferred embodiment, the impeller 20 further includes the annular shroud 22, which is arranged opposite to the one surface 21*a* of the disk-shaped portion 21. Further, because the first curvature portion 53 is arranged radially inward of the inner edge 22*a* of the shroud 22, that is, radially inward of the outer edge of the air inlet 42*c* of the impeller housing 40, air is easily sucked in through the first curvature portion 53, leading to an improvement in the air intake efficiency of the blower 10.

In addition, according to the present preferred embodiment, both the second curvature portions 54*a* and 54*b* are arranged radially outward of the inner edge 22*a* of the shroud 22. That is, because both the second curvature portions 54*a* and 54*b* are arranged radially outward of the inner edge 22*a* of the shroud 22, that is, radially outward of the air inlet 42*c* of the impeller housing 40, air sucked into the incoming air channel 20*a* is easily discharged through the second curvature portions 54*a* and 54*b*, leading to an improvement in the air exhaust efficiency of the blower 10.

In addition, according to the present preferred embodiment, the first curvature portion 53 and the second curvature portion 54*a*, which is adjacent to the first curvature portion 53, are arranged to be continuous with each other. Moreover, the first junction CP1, which is the junction of the first curvature portion 53 and the second curvature portion 54*a*, is arranged at the same radial position as that of the inner edge 22*a* of the shroud 22. Thus, the entire first curvature portion 53 is arranged radially inward of the inner edge 22*a* of the shroud 22, i.e., radially inward of the outer edge of the air inlet 42*c* of the impeller housing 40, while the second curvature portions 54*a* and 54*b* are entirely arranged radially outward of the inner edge 22*a* of the shroud 22, i.e., radially outward of the air inlet 42*c*. This leads to additional improvements in the air intake efficiency and the air exhaust efficiency of the blower 10.

In addition, if the radius r1 of curvature of the first curvature portion 53 were small, an eddy of air might be easily caused by the first curvature portion 53, which might lead to a reduction in the air intake efficiency.

In contrast, according to the present preferred embodiment, the center CR1 of the radius of curvature of the first curvature portion 53 is arranged radially outward of the inner edge 22*a* of the shroud 22. In other words, the center CR1 of the radius of curvature of the first curvature portion 53 is arranged radially outward of the inner edge 22*a* of the shroud 22, i.e., radially outward of the air inlet 42*c*, and the radius r1 of curvature of the first curvature portion 53 can accordingly be large. Therefore, according to the present preferred embodiment, it is possible to minimize a reduction in the air intake efficiency of the blower 10.

In addition, according to the present preferred embodiment, the rotor blades 50 include the plurality of second rotor blades 52. In other words, the rotor blades 50 include the plurality of second rotor blades 52 each of which is arranged circumferentially between adjacent ones of the first rotor blades 51. Further, the radially inner end portion of each second rotor blade 52 is arranged radially outward of the radially inner end portion of each first rotor blade 51. In addition, each second rotor blade 52 is arranged circumferentially between adjacent ones of the first rotor blades 51. This contributes to reducing the width of an air outlet at a discharge end portion of the incoming air channel 20*a*, i.e., at a radially outer end portion of the impeller 20. This in turn contributes to reducing the likelihood that air flowing in the incoming air channel 20*a* will separate from the rotor blades 50, and to enhancing the air blowing efficiency of the blower 10.

In addition, according to the present preferred embodiment, the impeller 20 further includes the annular shroud 22 arranged opposite to the one surface 21*a*. Further, the radially inner end portion of each second rotor blade 52 is arranged at the same radial position as that of the inner edge of the shroud 22, or radially outward of the inner edge of the shroud 22. More specifically, the radially inner end portion of each second rotor blade 52 is arranged at the same radial position as that of the inner edge 22*a* of the shroud 22, that is, the outer edge of the air inlet 42*c* of the impeller housing 40. Thus, the entire second rotor blade 52 is arranged radially outward of the air inlet 42*c*.

Accordingly, according to the present preferred embodiment, an intake of air by the first curvature portion 53 of each first rotor blade 51 is not hindered by any second rotor blade 52, and therefore, the air intake efficiency is not reduced by any second rotor blade 52.

In addition, according to the present preferred embodiment, each second rotor blade 52 includes the plurality of third curvature portions 55*a* and 55*b*, the centers CR31 and CR32 of the radii of curvature of which are arranged on the second side of the second rotor blade 52 with respect to the circumferential direction. Further, regarding the third curvature portions 55*a* and 55*b*, which are adjacent to each other, the radius r32 of curvature of the third curvature portion 55*b*, which is arranged radially outward, is greater than the radius r31 of curvature of the third curvature portion 55*a*, which is arranged radially inward. More specifically, each second rotor blade 52 includes the two third curvature portions 55*a* and 55*b*, the centers CR31 and CR32 of the radii of curvature of which are arranged on the rearward side of the second rotor blade 52. Further, regarding the two third curvature portions 55*a* and 55*b*, the radius r32 of curvature of the third curvature portion 55*b*, which is arranged radially outward, is greater than the radius r31 of curvature of the third curvature portion 55*a*, which is arranged radially inward. According to the present preferred embodiment, the air exhaust efficiency can accordingly be enhanced in a similar manner to that in which the air exhaust efficiency is enhanced by the second curvature portions 54*a* and 54*b* of each first rotor blade 51.

In addition, according to the present preferred embodiment, each second rotor blade 52 is made up of the two third curvature portions 55*a* and 55*b*. Further, the radius r31 of curvature of the third curvature portion 55*a*, which is arranged radially inward, is equal to the radius r21 of curvature of the second curvature portion 54*a*, which is arranged radially inward, while the radius r32 of curvature of the third curvature portion 55*b*, which is arranged radially outward, is equal to the radius r22 of curvature of the second curvature portion 54*b*, which is arranged radially outward. That is, the shape of the second rotor blade 52 is identical to the shape of the entire portion of the first rotor blade 51, excluding the first curvature portion 53. Therefore, it is possible to manufacture a portion of the first rotor blade 51 and the second rotor blade 52 with the same design and with molds having the same shapes. Accordingly, according to the present preferred embodiment, the design of the impeller 20 can be simplified, and an ability to mass-produce the impellers 20 can be improved.

In addition, according to the present preferred embodiment, the incoming air channel 20*a* is defined in the impeller 20 as the impeller 20 includes the shroud 22. Thus, pressure of air sucked into the impeller 20 can be increased in the incoming air channel 20*a*. Having the above structure, the impeller 20 is suitable for use in a blower installed in a vacuum cleaner or the like, which is required to increase pressure of air which to be sent.

In addition, according to the present preferred embodiment, the length of the second curvature portion 54*b*, which is arranged radially outward, is greater than the length of the second curvature portion 54*a*, which is arranged radially inward. This makes it easy to shape a portion of each first rotor blade 51 which is defined by the second curvature portions, that is, an entire portion of each first rotor blade 51 which is radially outward of the first curvature portion 53, in such a manner as to minimize the likelihood that air will separate from the first rotor blade 51. Thus, according to the present preferred embodiment, the air blowing efficiency of the blower 10 can be enhanced. The same is true of each second rotor blade 52.

Note that the present preferred embodiment can be modified in any of the following manners.

The radius r1 of curvature of the first curvature portion 53 may be arranged to be greater than both the radii r21 and r22 of curvature of the second curvature portions 54*a* and 54*b* in a modification of the present preferred embodiment. This arrangement contributes to enhancing the air intake efficiency, as the radius r1 of curvature of the first curvature portion 53 is increased.

Further, in a modification of the present preferred embodiment, the radius r1 of curvature of the first curvature portion 53 may be arranged to be equal to either the radius r21 of curvature of the second curvature portion 54*a* or the radius r22 of curvature of the second curvature portion 54*b*.

Furthermore, relative lengths of the curvature portions may be set in any manner in a modification of the present preferred embodiment. For example, the lengths of the curvature portions may be equal to each other in a modification of the present preferred embodiment.

Furthermore, three or more second curvature portions may be provided in each first rotor blade 51 in a modification of the present preferred embodiment. As the number of second curvature portions increases, flexibility in the shape of the second curvature portions as a whole increases, making it possible to modify the structure of the impeller 20 so as to further enhance the air blowing efficiency of the blower 10.

Furthermore, in a modification of the present preferred embodiment, a portion of the first curvature portion 53 may be arranged radially outward of the inner edge 22*a* of the shroud 22, that is, radially outward of the air inlet 42*c* of the impeller housing 40. In other words, in the present preferred embodiment and modifications thereof, at least a portion of the first curvature portion 53 may be arranged radially inward of the inner edge 22*a* of the shroud 22, that is, radially inward of the outer edge of the air inlet 42*c* of the impeller housing 40.

Furthermore, in modifications of the present preferred embodiment, no particular limitation is imposed on the number of first rotor blades 51 and the number of second rotor blades 52, and the number of first rotor blades 51 and the number of second rotor blades 52 may be smaller than five or greater than five. Also, the number of first rotor blades 51 and the number of second rotor blades 52 may be different from each other.

Furthermore, in the present preferred embodiment described above, the plurality of first rotor blades 51 are all arranged to have the same shape, but this is not essential to the present invention. In a modification of the present preferred embodiment, the plurality of first rotor blades 51 may be arranged to have mutually different shapes. The plurality of second rotor blades 52 may also be arranged to have mutually different shapes.

Furthermore, in a modification of the present preferred embodiment, the plurality of rotor blades 50 may include a rotor blade other than the first rotor blades 51 and the second rotor blades 52.

Furthermore, in a modification of the present preferred embodiment, each first rotor blade 51 may include a portion other than the first curvature portion 53 and the second curvature portions 54*a* and 54*b*. For example, a straight portion or a curved portion may be provided radially inward of the first curvature portion 53, radially outward of the second curvature portion 54*b*, or between adjacent ones of the curvature portions.

Furthermore, in a modification of the present preferred embodiment, the impeller 20 may not include the shroud 22. In this case, the amount of air discharged out of the impeller 20 can be increased. Therefore, the impeller including no shroud is suitable for use in a blower installed in a drier or the like, which is required to send a large amount of air.

Furthermore, although it has been assumed that the impeller 20 according to the present preferred embodiment is installed in the blower 10, this is not essential to the present invention. Impellers according to other preferred embodiments of the present invention may be installed in other devices, such as, for example, compressors.

Experiment

The air blowing efficiency and shaft power of the blower 10 according to the present preferred embodiment were calculated by a simulation, and were compared with those of a blower according to a comparative example.

The blower 10 according to the present preferred embodiment has the structure described above with reference to FIGS. 1 to 5.

An impeller of the blower according to the comparative example includes a plurality of rotor blades each of which is of the same type and is made up of only one second curvature portion. The blower according to the comparative example is otherwise similar in structure to the blower 10 according to the present preferred embodiment.

Results of the simulation are shown in FIG. 6. In FIG. 6, the maximum air blowing efficiency (%) and maximum shaft power (W) are shown.

As shown in FIG. 6, it was observed that the blower 10 according to the present preferred embodiment is capable of reducing the maximum shaft power by 119 W compared to the blower according to the comparative example. This means that the present preferred embodiment makes it possible to reduce a load of the motor used to rotate the impeller.

In addition, it was observed that the blower 10 according to the present preferred embodiment achieves a 4% improvement in the maximum air blowing efficiency compared to the blower according to the comparative example.

Thus, the experiment confirmed usefulness of the present invention.

Preferred embodiments of the present invention are applicable to, for example, impellers and blowers.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An impeller arranged to rotate about a central axis, the impeller comprising:

a disk-shaped portion that extends radially with respect to the central axis; and a plurality of rotor blades arranged along a circumferential direction on one surface of the disk-shaped portion, each rotor blade including one end at an outer edge portion of the disk-shaped portion, and an opposite end radially inward of the outer edge portion of the disk-shaped portion; wherein the rotor blades include a plurality of first rotor blades each of which includes a first curvature portion and a plurality of second curvature portions;

a center of a radius of curvature of the first curvature portion of each first rotor blade is on a first side of the first rotor blade with respect to the circumferential direction;

a center of a radius of curvature of each second curvature portion of each first rotor blade is on a second side of the first rotor blade with respect to the circumferential direction;

the first curvature portion is radially inward of each second curvature portion; and regarding adjacent ones of the second curvature portions of each first rotor blade, the radius of curvature of the second curvature portion radially outward is greater than the radius of curvature of the second curvature portion radially inward; and the rotor blades further include a plurality of second rotor blades;

a radially inner end portion of each second rotor blade is radially outward of a radially inner end portion of each first rotor blade; and each second rotor blade is circumferentially between adjacent ones of the first rotor blades; and each second rotor blade includes a plurality of third curvature portions, a center of a radius of curvature of each third curvature portion being on the second side of the second rotor blade with respect to the circumferential direction; and regarding adjacent ones of the third curvature portions, the radius of curvature of the third curvature portion radially outward is greater than the radius of curvature of the third curvature portion radially inward.

2. The impeller according to claim 1, wherein each first rotor blade is made up of the first curvature portion and two of the second curvature portions.

3. The impeller according to claim 1, further comprising an annular shroud opposite to the one surface of the disk-shaped portion, wherein at least a portion of the first curvature portion is radially inward of an inner edge of the shroud.

4. The impeller according to claim 3, wherein each second curvature portion is radially outward of the inner edge of the shroud.

5. The impeller according to claim 3, wherein the first curvature portion and an adjacent one of the second curvature portions are continuous with each other; and a junction of the first curvature portion and the adjacent second curvature portion is located at a same radial position as that of the inner edge of the shroud.

6. The impeller according to claim 3, wherein the center of the radius of curvature of the first curvature portion is radially outward of the inner edge of the shroud.

7. The impeller according to claim 1, further comprising an annular shroud opposite to the one surface of the disk-shaped portion, wherein the radially inner end portion of each second rotor blade is at a same radial position as that of an inner edge of the shroud, or radially outward of the inner edge of the shroud.

8. The impeller according to claim 1, wherein an axial dimension of the each rotor blade decreases with increasing distance from the central axis.

9. The impeller according to claim 1, wherein each first rotor blade is made up of the first curvature portion and two of the second curvature portions;

each second rotor blade is made up of two of the third curvature portions;

the radius of curvature of the third curvature portion radially inward is equal to the radius of curvature of the second curvature portion radially inward; and the radius of curvature of the third curvature portion radially outward is equal to the radius of curvature of the second curvature portion radially outward.

10. The impeller according to claim 1, wherein the radius of curvature of the first curvature portion is greater than the radius of curvature of each second curvature portion.

11. The impeller according to claim 1, wherein a length of the second curvature portion radially outward is greater than a length of the second curvature portion radially inward.

12. The impeller according to claim 1, wherein a straight portion or a curved portion is provided radially inward of the first curvature portion, radially outward of the second curvature portion, or between adjacent ones of the curvature portions.

13. A blower comprising:

the impeller according to claim 1;

a motor that rotates the impeller about the central axis; and an impeller housing that accommodates the impeller.

14. The blower according to claim 13, wherein the impeller housing includes an air inlet at a position opposite to the one surface of the disk-shaped portion; and the impeller comprises an annular shroud opposite to the one surface of the disk-shaped portion; and an inner edge of the shroud and an outer edge of the air inlet of the impeller housing substantially overlap with each other in the plan view.

15. The blower according to claim 13, wherein the impeller housing includes an air inlet at a position opposite to the one surface of the disk-shaped portion; and at least a portion of the first curvature portion is radially inward of an outer edge of the air inlet.

16. The blower according to claim 15, wherein each second curvature portion is radially outward of the air inlet.

17. The blower according to claim 15, wherein the first curvature portion and an adjacent one of the second curvature portions are continuous with each other; and a junction of the first curvature portion and the adjacent second curvature portion is at a same radial position as that of the outer edge of the air inlet.

18. The blower according to claim 15, wherein the center of the radius of curvature of the first curvature portion is radially outward of the air inlet.

* * * * *